US009211728B1

(12) United States Patent
Bucks et al.

(10) Patent No.: US 9,211,728 B1
(45) Date of Patent: Dec. 15, 2015

(54) METHOD FOR HEATING A SUBSTRATE IN A PRINTING DEVICE

(71) Applicants: Rodney Ray Bucks, Webster, NY (US); W. Charles Kasiske, Jr., Webster, NY (US); John Leonard Hryhorenko, Webster, NY (US); David Francis Cahill, Rochester, NY (US); James Alan Katerberg, Kettering, OH (US)

(72) Inventors: Rodney Ray Bucks, Webster, NY (US); W. Charles Kasiske, Jr., Webster, NY (US); John Leonard Hryhorenko, Webster, NY (US); David Francis Cahill, Rochester, NY (US); James Alan Katerberg, Kettering, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/286,276

(22) Filed: May 23, 2014

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 2/01; B41J 2/04528; B41J 2/04541; B41J 2/04543; B41J 2/04553; B41J 2/0458; B41J 2/04563; B41J 11/0015; B41J 11/002; B41J 29/38; B41J 29/393; B41M 7/0072; C09D 11/101
USPC ..... 347/5, 17, 19, 102
See application file for complete search history.

(56) References Cited

U.S. PATENT DOCUMENTS

| | | | | |
|---|---|---|---|---|
| 6,877,247 | B1 | 4/2005 | DeMoore | |
| 8,509,606 | B2 | 8/2013 | Leighton et al. | |
| 2007/0182798 | A1* | 8/2007 | Makihira et al. | 347/102 |
| 2011/0261127 | A1* | 10/2011 | Kovacs et al. | 347/102 |
| 2012/0188318 | A1 | 7/2012 | Yamanobe | |
| 2012/0206527 | A1* | 8/2012 | Leighton et al. | 347/16 |
| 2012/0287195 | A1 | 11/2012 | Boland et al. | |
| 2013/0280126 | A1 | 10/2013 | Statham et al. | |

* cited by examiner

*Primary Examiner* — Manish S Shah
*Assistant Examiner* — Roger W Pisha, II
(74) *Attorney, Agent, or Firm* — Peyton C. Watkins; William R. Zimmerli

(57) ABSTRACT

A method for heating a substrate in a printing device, the method comprises positioning at least one radiant heater along a printing path of a printing device, the at least one radiant heater includes at least two emitters; measuring a voltage and current supplied to each of the at least two emitters; determining an electrical power supplied to each of the at least two emitters; and adjusting the electrical power supplied to at least one of the at least two emitters if a difference in power supplied to each of the at least two emitters exceeds a threshold.

15 Claims, 4 Drawing Sheets

METHOD FOR HEATING A SUBSTRATE IN A PRINTING DEVICE

CROSS-REFERENCE TO RELATED APPLICATIONS

Reference is made to commonly-assigned, co-pending U.S. patent application Ser. No. 14/286,321 filed concurrently herewith, entitled "A DRYER FOR HEATING A SUBSTRATE", by Rodney R. Bucks, et al the disclosure of which is incorporated herein.

FIELD OF THE INVENTION

The present invention generally relates to dryers for continuous inkjet printers and more particularly to a method for more uniformly drying print media passing through printers.

BACKGROUND OF THE INVENTION

In a digitally controlled inkjet printing system, a receiver medium (also referred to as a print medium) is conveyed past a series of components. The receiver medium can be a cut sheet of a receiver medium or a continuous web of a receiver medium. A web or cut sheet transport system physically moves the receiver medium through the printing system. As the receiver medium moves through the printing system, liquid (e.g., ink) is applied to the receiver medium by one or more printheads through a process commonly referred to as jetting of the liquid. The jetting of liquid onto the receiver medium introduces significant moisture content to the receiver medium, particularly when the system is used to print multiple colors on a receiver medium. Dryers are then used to remove moisture from the receiver medium.

Although the prior art methods are satisfactory, they include drawbacks. Due to aging and the like, the heating elements within the dryer do not heat uniformly. Consequently a need exists for more uniform heating within the dryer so that the print medium passing through it is uniformly heated.

SUMMARY OF THE INVENTION

The present invention is directed to overcoming one or more of the problems set forth above. Briefly summarized, according to one aspect of the invention, the invention resides in a method for heating a substrate in a printing device, the method comprises positioning at least one radiant heater along a printing path of a printing device, the at least one radiant heater includes at least two emitters; measuring a voltage and current supplied to each of the at least two emitters; determining an electrical power supplied to each of the at least two emitters; and adjusting the electrical power supplied to at least one of the at least two emitters if a difference in power supplied to each of the at least two emitters exceeds a threshold.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
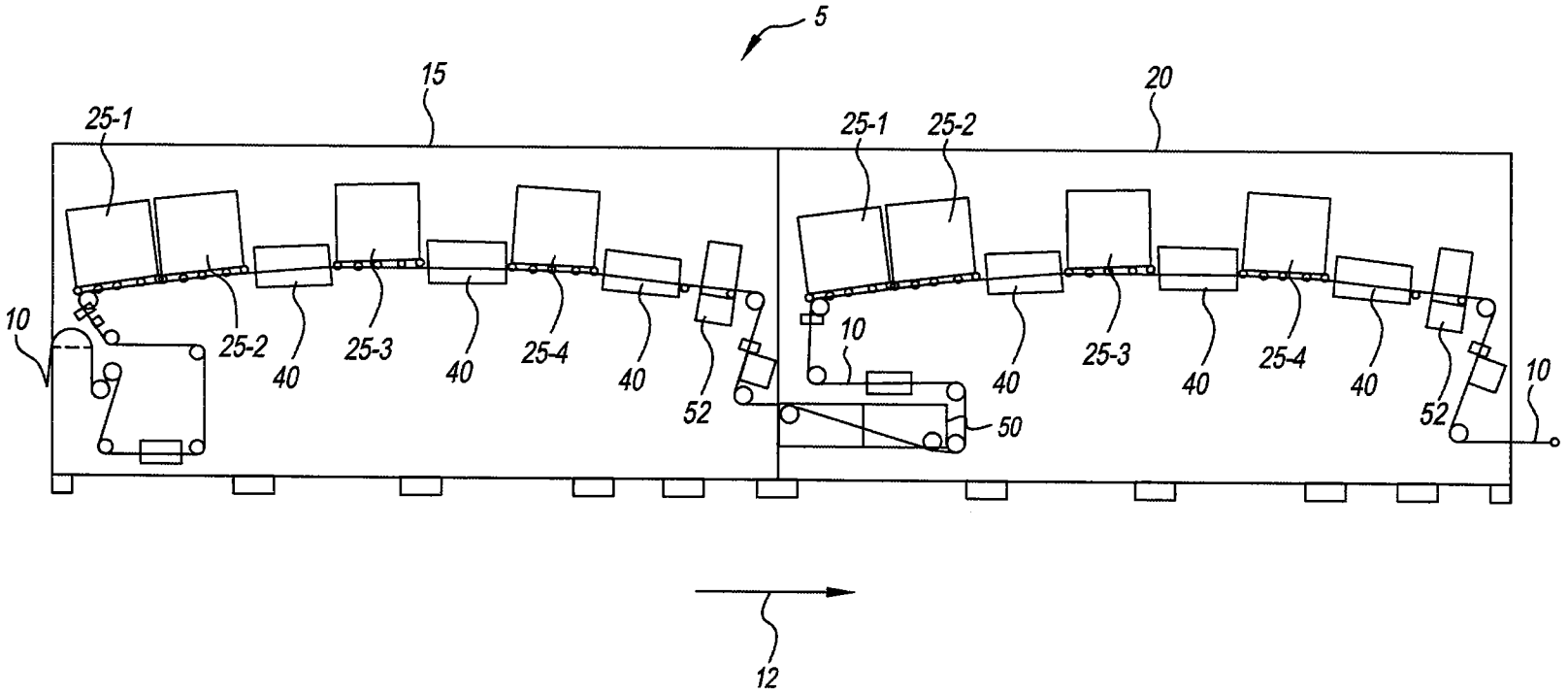
FIG. 1 is a schematic side view of a digital printing system for continuous web printing on a print medium.

Referring to FIG. 1, there is shown a digital printing system 5 for continuous web printing on a print medium 10. The digital printing system 5 includes a first module 15 and a second module 20, each of which includes lineheads 25-1-25-4, dryers 40, and a quality control sensor 52. In addition, the first module 15 and the second module 20 include a web tension system (not shown) that serves to physically move the print medium 10 through the digital printing system 5 in the in-track direction 12 (left to right as shown in the figure).

The print medium 10 enters the first module 15, from the source roll (not shown). The linehead(s) 25-1-25-4 of the first module applies ink to one side of the print medium 10. As the print medium 10 feeds into the second module 20, there is a turnover mechanism 50 which inverts the print medium 10 so that linehead(s) 25-1-25-4 of the second module 20 can apply ink to the other side of the print medium 10. The print medium 10 then exits the second module 20 and is collected by a print medium receiving unit (not shown). For descriptive purposes only, the lineheads are labeled a first linehead 25-1, a second linehead 25-2, a third linehead 25-3, and a fourth linehead 25-4.

Figure 2:
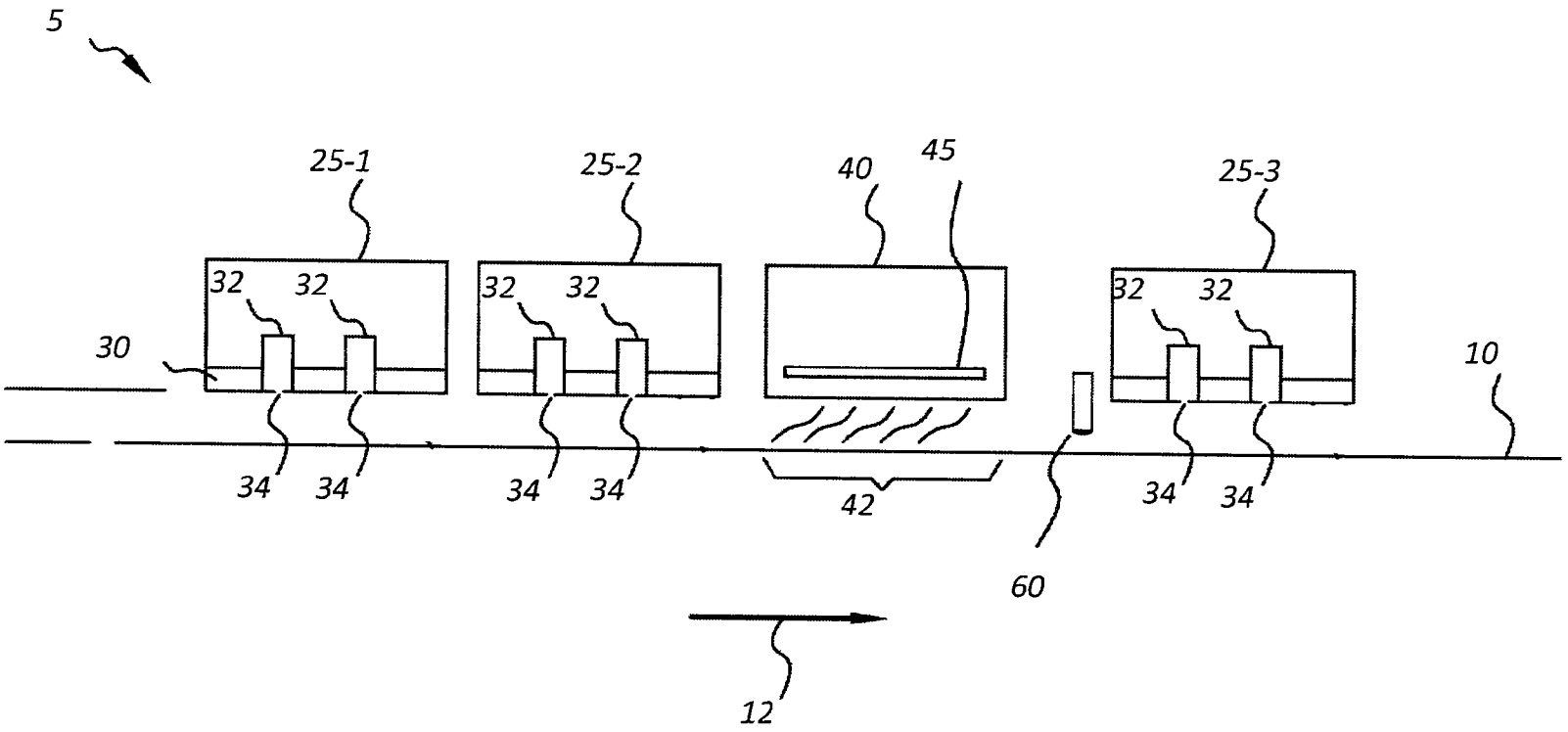
FIG. 2 is a schematic side view of components in a portion of the digital printing system.
Figure 3:
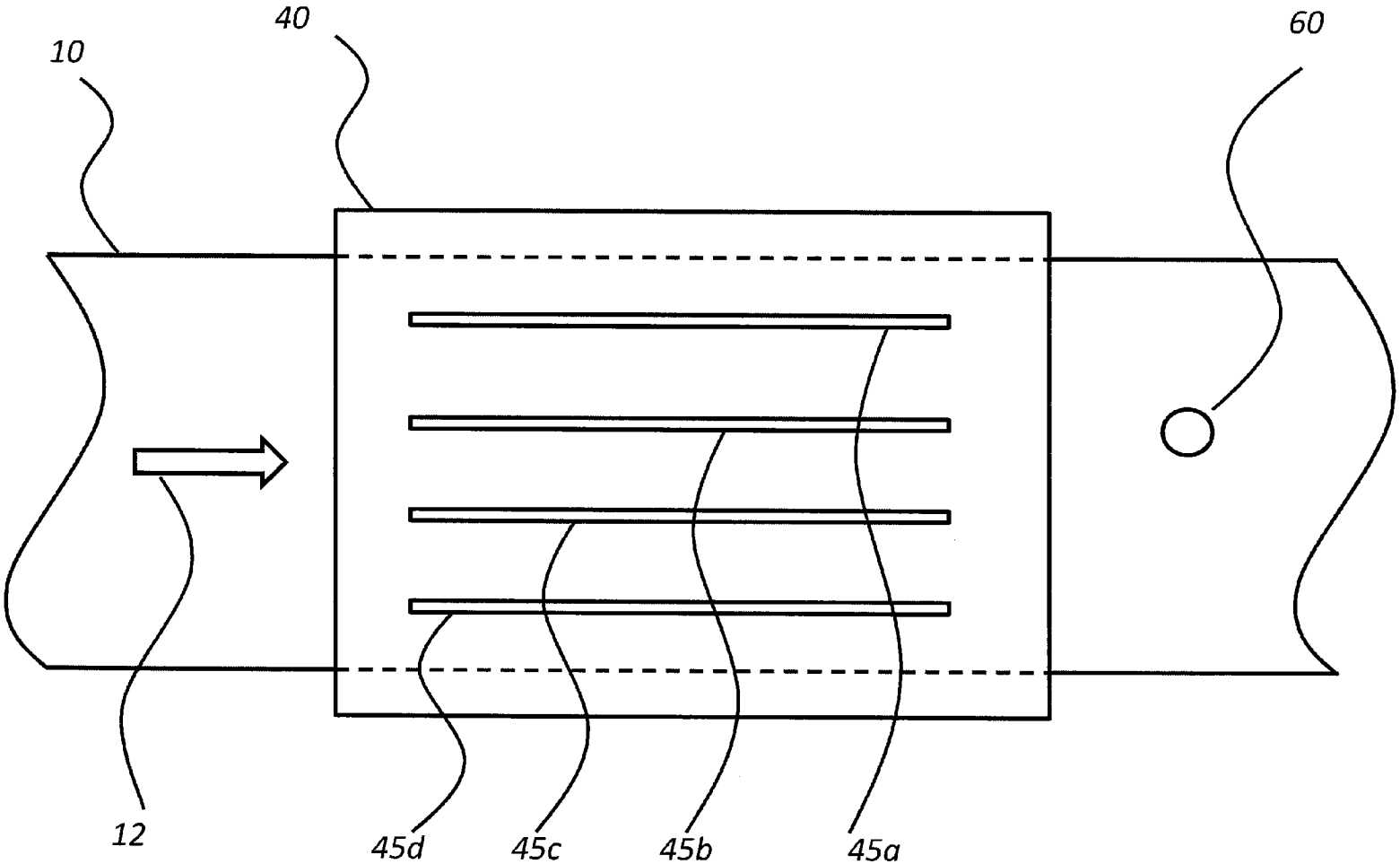
FIG. 3 is a top view of the dryer of FIG. 2 illustrating the emitters within the dryer.
Figure 4:
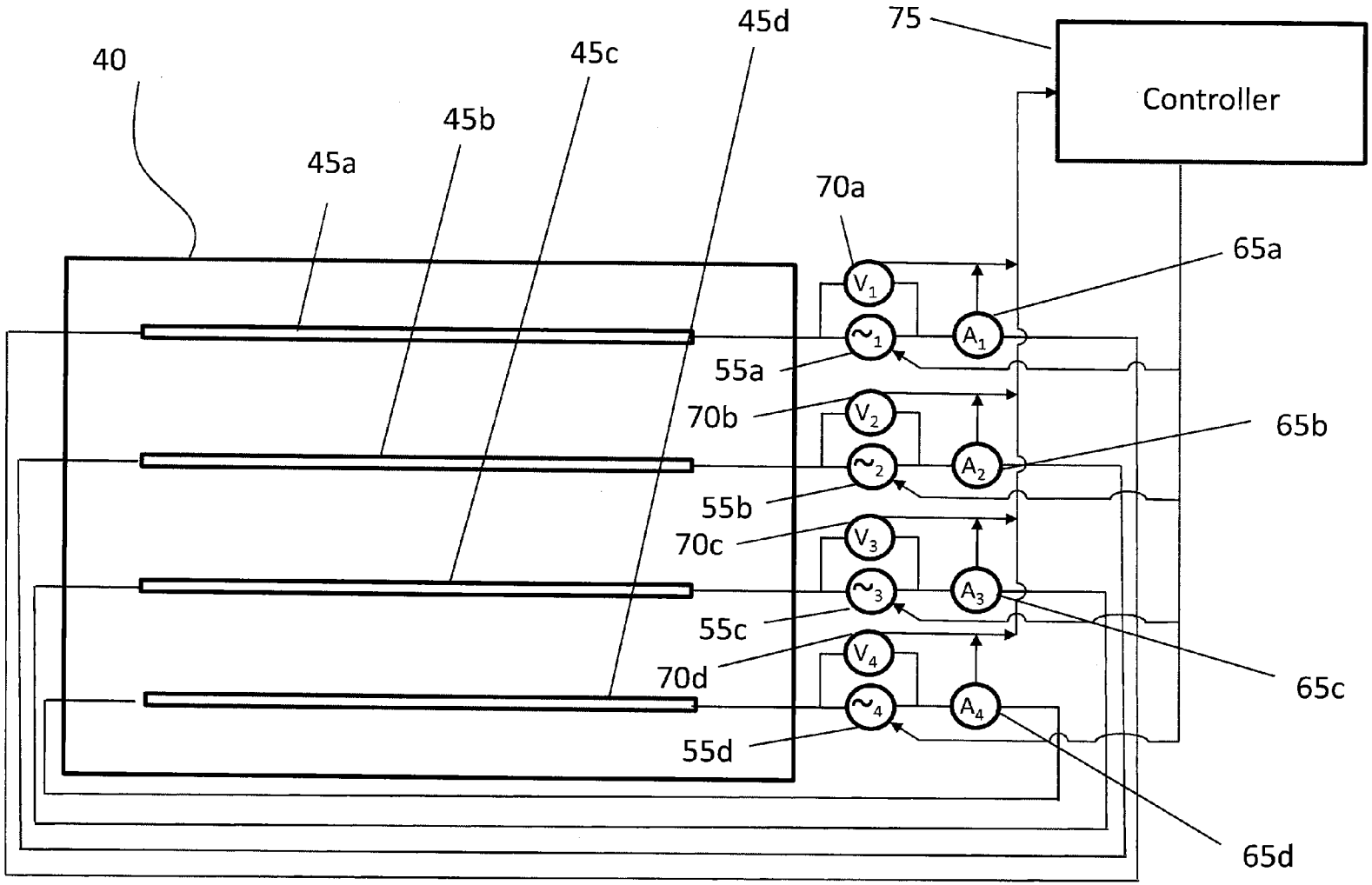
FIG. 4 is a schematic diagram of the dryer.

Referring to FIG. 2, a portion of the digital printing system 5 is shown in more detail. As the print medium 10 is directed through the digital printing system 5, the lineheads 25-1-25-4, which typically include a plurality of printheads 32, apply ink or another liquid, via the nozzle arrays 34 of the printheads 32. The printheads 32 within the lineheads 25-1-25-4 are located and aligned by a support structure 30. After the ink is jetted onto the print medium 10, the print medium 10 passes beneath the one or more dryers 40 which apply heat to the ink on the print medium 10. The applied heat accelerates the evaporation of the water or other solvents in the ink. The dryer 40 is preferably a radiant heater 42 and includes a plurality of emitters 45 which generates the heat for drying the print medium 10. Referring to both FIGS. 2 and 3, the emitters 45 (labeled 45*a*-45*d* in FIG. 3) are preferably positioned in the in-track direction 12, the direction of the flow of the print medium 10. It is noted that positioning the emitters 45*a*-45*d* (FIG. 3) in the in-track direction 12 provides the advantage of permitting the outer emitters 45*a* and 45*d* to be turned completely off if the print medium 10 is narrower than the width of the emitter array. While the dryers of FIGS. 2 & 3 include four emitters 45*a*-45*d*, the invention is applicable to dryers 40 having two or more emitters 45. A temperature sensor 60 is positioned adjacent the radiant heater 42 for measuring the temperature of the web after exiting the dryer 40. Preferably, a single temperature sensor 60 is associated with each dryer 40, and is typically positioned downstream of the radiant heater 42. The emitters 45 are preferably carbon, tungsten halogen, or quartz emitters operating at a color temperature of between 3000K and 700K. Although only one dryer 40 is shown in FIG. 2, a plurality of dryers 40 is typically used as shown in FIG. 1. It has been found that heat applied to the web of print medium 10 by the different emitters 45 can vary significantly even when they are nominally the same. As a result, the temperature of the print medium 10 as it leaves a dryer 40 can vary significantly across the width of the dryer 40. Excessive temperature differences across the print medium 10 can cause either or both some portions to be insufficiently dried or some portions of the print medium 10 to become sufficiently hot that there can be an increased risk of moisture condensing onto printer components downstream of the dryer 40. Referring to FIG. 4, the four emitters 45*a*-45*d* are each respectively connected to its associated circuitry. For simplicity of discussion, only one emitter 45*a* and its associated circuit will be discussed in detail while it is noted that each emitter 45*b*-45*d* includes the same associated circuits, for example voltage sources 55*b*-55*d*, volt meters 70*b*-70*d* and amp meters 65*b*-65*d* respectively. In this regard, emitter 45*a* includes a voltage source 55*a* and an amp meter 65*a* connected in series to the emitter 45*a*. The voltage source 55*a* provides the electrical current for energizing the emitter 45*a*, and the amp meter 65*a* measures the amount of current flowing through the circuit. A volt meter 70*a* measures the voltage across voltage source 55*a*. When energized, the emitter 45*a* generates radiant heat for heating the print medium 10, and the amp meter 65*a* and volt meter 70*a* respectively monitor the current and voltage. A controller 75 receives a signal from both the volt meter 70*a* and amp meter 65*a* and uses this information to calculate the electrical power for this particular circuit as is well known in the art. In general, the impedance of the emitters 45*a*-45*d* is primarily resistive, so that the voltage and current are in phase with each other and the electrical power supplied to the emitters 45*a*-45*d* is the product of the voltage and the current. If emitters45*a*-45*d* are used that have a significant capacitance or inductance, a phase meter can also be used to measure the phase between the voltage and current so that the real portion of the electrical power supplied to the emitters 45*a*-45*d* can be determined. If it is determined that one emitter 45 is receiving more electrical power than a second emitter 45, by more than some defined threshold amount such as 3% more, then the controller 75 compensates for this by adjusting the voltage, and therefore the electrical power to at least one of the two emitters 45 to a desired balance of power. The collective power output of the dryer 40 is the sum of the outputs of each of the individual emitters 45*a*-45*d*. There is a dryer power output setting that is used to control the collective power delivered by all of the emitters 45*a*-45*d* in the dryer 40. A target power value for the individual emitter circuits can simply be determined by dividing the dryer target power value by the number of emitters 45 in the dryer hereinafter called the emitter power target value. If the individual emitter circuit calculated power differs from the emitter target power value by more a threshold value, preferably equal to or greater than 3%, the controller sends a signal to the voltage source 55 to adjust its output accordingly so that the power output of all emitters 45*a*-45*d* is substantially equal and so that the power output of the emitters 45*a*-45*d* collectively matches the dryer power target value. For example, if the emitter target power value is 1000 watts, 1030 watts or greater or 970 watts or less would trigger the adjustment. The dryer target power value is determined by the controller 75 typically in response to the print speed of the printer and to a setting provided by the printer operator or determined by a controller 75. In regard to operator control, the operator may observe some characteristics of the print medium 10 or some aspect of the digital printing system 5 and alter the power settings of the dryer 40. In regard to the determination by the controller 75, a target temperature is predetermined from prior knowledge of the digital printing system 5 or the print medium characteristics. The temperature sensor 60 (FIG. 3) provides temperature feedback to the controller 75. The controller 75 then adjusts the power settings of the dryer 40 until the target temperature is achieved. The setting of the dryer target power values by the controller 75 as described above is one example of how the dryer target value may be determined.

In an alternative embodiment, the emitter target power value is set to be equal to the measured power of a reference emitter 45, for example emitter 45*b*. The reference emitter 45 is preferably in line with the temperature sensor 60 as illustrated in FIG. 3. In this case, a dryer target power value is not needed.

The above description applies to the emitters 45*b*-45*d* so that the controller 75 is permitted to monitor and adjust the output of each emitter 45*a*-45*d* as determined by the target power value and the allowed emitter power variation. This provides improved radiant energy uniformity by adjusting the supplied voltage to each emitter 45*a*-45*d* so that the electrical power of each emitter 45*a*-45*d* is the same. A significant reduction in emitter energy output variability and an improvement in delivered energy uniformity are achieved by monitoring the RMS (root mean square) voltage supplied to each emitter 45*a*-45*d* and the RMS current passing through each emitter 45*a*-45*d*, when compared to prior art systems that supplied a uniform supply voltage to each of the emitters 45*a*-45*d*.

The invention provides better control in variable data printing systems than does a system that constantly monitors the temperature uniformity across the width of the print medium 10, and varies the power delivered to the various emitters 45*a*-45*d* in response to that measured temperature uniformity. This is due to the variability, both spatially across the web and over time, of ink applied to the print medium 10. The varying amounts of ink applied, as it is evaporated from the print medium 10 in the dryer 40, provide varying amounts of evaporative cooling to the print medium 10. Such varying amounts of web cooling can cause dryer control systems that try to maintain a uniform temperature across the print medium 10 to operate erratically. The present invention avoids such problems by monitoring the electrical power supplied to each emitter 45*a*-45*d* and adjusting the supply voltage to the various emitters 45*a*-45*d* to produce the desired balance of supplied power.

The controller 75 receives voltage and current measurements from the volt meters 70*a*-70*d* and amp meters 65*a*-65*d* associated with each of the dryer emitters 45. In some embodiments of the invention, through monitoring and analysis of these measurements, the controller 75 can detect early signs of an impending emitter 45 failure. The controller 75 can then provide a warning to the operator of the impending failure so that the failing emitter 45 can be replaced.

The invention has been described in detail with particular reference to certain preferred embodiments thereof, but it will be understood that variations and modifications can be effected within the spirit and scope of the invention.

PARTS LIST

5 Digital printing system
10 Print medium
12 In-track direction
15 First module
20 Second module
25-1 First Linehead
25-2 Second Linehead
25-3 Third Linehead
25-4 Fourth Linehead

30 Support Structure
32 Printheads
34 Nozzle arrays
40 Dryers
42 Radiant Heater
45 Emitter
45*a*-45*d* Emitters
50 Turnover Mechanism
55 Voltage Source
55*a*-55*d* Voltage Sources
60 Temperature Sensor
65*a*-65*d* Amp Meters
70*a*-70*d* Volt Meters
75 Controller

The invention claimed is:

1. A method for heating a substrate in a printing device, the method comprising:

positioning a radiant heater along a printing path of a printing device, the radiant heater including a plurality of emitters;

measuring a voltage and a current supplied to each of the plurality of emitters;

determining an electrical power supplied to each of the plurality of emitters using the measured voltage and current;

determining whether the electrical power supplied to one of the plurality of emitters differs from the electrical power supplied to another of the plurality of emitters by more than a threshold amount; and if the electrical power supplied to one of the plurality of emitters differs from the electrical power supplied to another of the plurality of emitters by more than the threshold amount, adjusting the electrical power supplied to one of the plurality of emitters to reduce the electrical power difference between the plurality of emitters.

2. The method as in claim 1, further comprising a single temperature sensor positioned adjacent the radiant heater for measuring web temperature in proximity to an exit of the radiant heater.

3. The method as in claim 2, wherein the single temperature sensor is positioned downstream of the radiant heater.

4. The method as in claim 1, wherein the emitters are carbon, tungsten halogen, or quartz emitters operating at a color temperature of between 3000K to 700K.

5. The method as in claim 1, wherein the threshold is 3% or greater of the electrical power supplied to one of the plurality of emitters.

6. The method as in claim 1, wherein the emitters are positioned with their primary axes parallel or substantially parallel to the in-track or medium transport direction.

7. The method as in claim 1, further comprising using a printhead to apply liquid to the print media upstream of the radiant heater.

8. The method as in claim 1, wherein the measured voltage and current are measured as an RMS voltage and current.

9. The method as in claim 1, further comprising the step of determining a dryer target power value.

10. The method as in claim 9, further comprising the step of determining the emitter target power value from the dryer target power value.

11. The method as in claim 1, wherein adjusting the electrical power includes adjusting the power output of all emitters to be substantially equal so that the power output of the emitters collectively matches the dryer power target value.

12. The method as in claim 1, further comprising the step of setting an emitter target power value equal to the measured power of a reference emitter.

13. The method as in claim 12, wherein the reference emitter is in line with the temperature sensor.

14. The method of claim 1, each of the plurality of emitters having a target power value, wherein adjusting the electrical power supplied to one of the plurality of emitters includes adjusting the electrical power of an emitter if the determined electrical power supplied to the emitter differs from the emitter target power value by more a threshold value to reduce the electrical power difference between the electrical power supplied to the emitter and the emitter target power value.

15. The method as in claim 1, further comprising analyzing the electrical power supplied to each of the plurality of emitters to determine an impending failure to any of the plurality of emitters.

* * * * *